United States Patent [19]

Davis et al.

[11] 4,334,662

[45] Jun. 15, 1982

[54] LANYARD SUPPORT FOR METAL BUILDING ROOF

[75] Inventors: Thomas R. Davis; Charles D. Bostian, both of Pettis County, Mo.

[73] Assignee: Tempel-Callison Company, Sedalia, Mo.

[21] Appl. No.: 184,781

[22] Filed: Sep. 5, 1980

[51] Int. Cl.[3] ..... E04G 3/12

[52] U.S. Cl. ..... 248/237; 182/45

[58] Field of Search ..... 182/45, 36, 38, 129, 182/150; 248/237

[56] References Cited

U.S. PATENT DOCUMENTS

| | | | |
|---|---|---|---|
| 235,126 | 12/1880 | Calhoun | 248/237 |
| 789,034 | 5/1905 | Jones | 248/237 |
| 789,640 | 5/1905 | Wainwright | 248/237 |
| 1,412,060 | 4/1922 | Mattson | 182/45 |
| 2,231,560 | 2/1941 | Campion | 182/45 |
| 4,048,924 | 9/1977 | Wibben | 182/38 |

*Primary Examiner*—Reinaldo P. Machado

*Attorney, Agent, or Firm*—Kokjer, Kircher, Bradley, Wharton, Bowman & Johnson

[57] ABSTRACT

This invention is directed to a device for supporting a load on a standing seam roof. A platform is provided for spanning the distance between two adjacent roof seams and camming means are mounted on opposite sides of the platform means for engaging the parallel roof seams. Each of the camming means is provided with backup means disposed on the opposite side of the seam from the camming means and disposed to abut against the roof seam. This provides a backup for the camming means when the latter engages the roof seam.

8 Claims, 3 Drawing Figures

LANYARD SUPPORT FOR METAL BUILDING ROOF

This invention relates generally to carriers for travel over building roofs and, more particularly, to a device for supporting a load on a standing seam metal roof.

A popular type of metal building construction employs standing lock seams between the panels of the building roof. This causes certain difficulties in providing a support framework on the roof particularly when all of the roof panels are in place, making it impossible to drop an anchor from a carrier down into the interior of the building. Prior art constructions for carriers designed to travel over the standing seams of a metal building roof have utilized anchor lines which either extend down into the building, where this is possible or, if necessary, extend all the way across the building to the opposite side for anchoring to some stationary object off of the building. This method of anchoring an over-the-roof carrier support is time consuming to install, requires large amounts of rope or cable, and is cumbersome and time consuming to move from one location to another.

The present invention provides a device for supporting a load on a standing seam roof which is self-anchoring and requires no cables or other anchoring devices extending down through or away from the building.

It is, therefore, a primary object of the present invention to provide a device for supporting a load on a standing seam roof which is anchored directly to the roof without the need for cables or other external supports.

It is an important aim of the invention to provide a device for supporting a load on a standing seam roof which utilizes the roof seams as a track and which is movable over the seams to any desired location yet which does not require external anchor cables for locking the device in place.

An objective of the invention is to provide a device for supporting a load on a standing seam roof which requires no external anchor cables and which is particularly suited for use in supporting a lanyard for holding a workman on the building.

Other objects of the invention will be made clear or become apparent from the following description and claims when read in light of the accompanying drawings, wherein:

Figure 1:
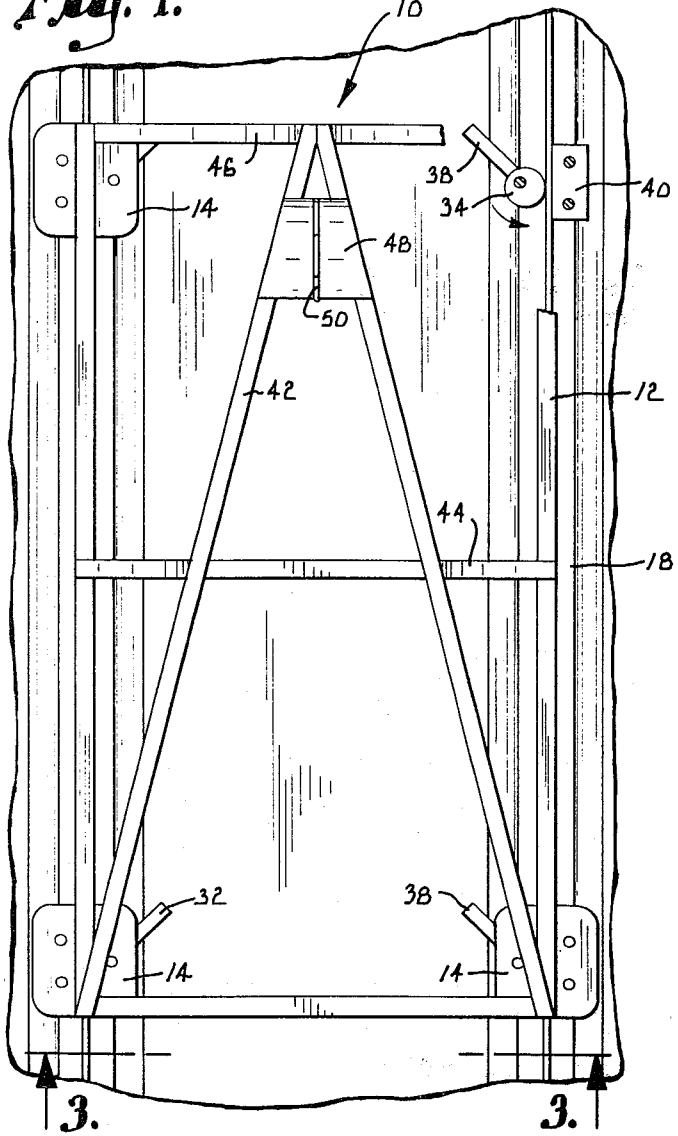
FIG. 1 is a top plan view of the device according to the present invention.

Referring initially to FIG. 1, the support device of the present invention is designated generally by the numeral 10. Device 10 comprises a generally rectangular platform 12 having mounting plates 14 at each of its four corners. Each mounting plate is rigid with platform 12.

Figure 2:
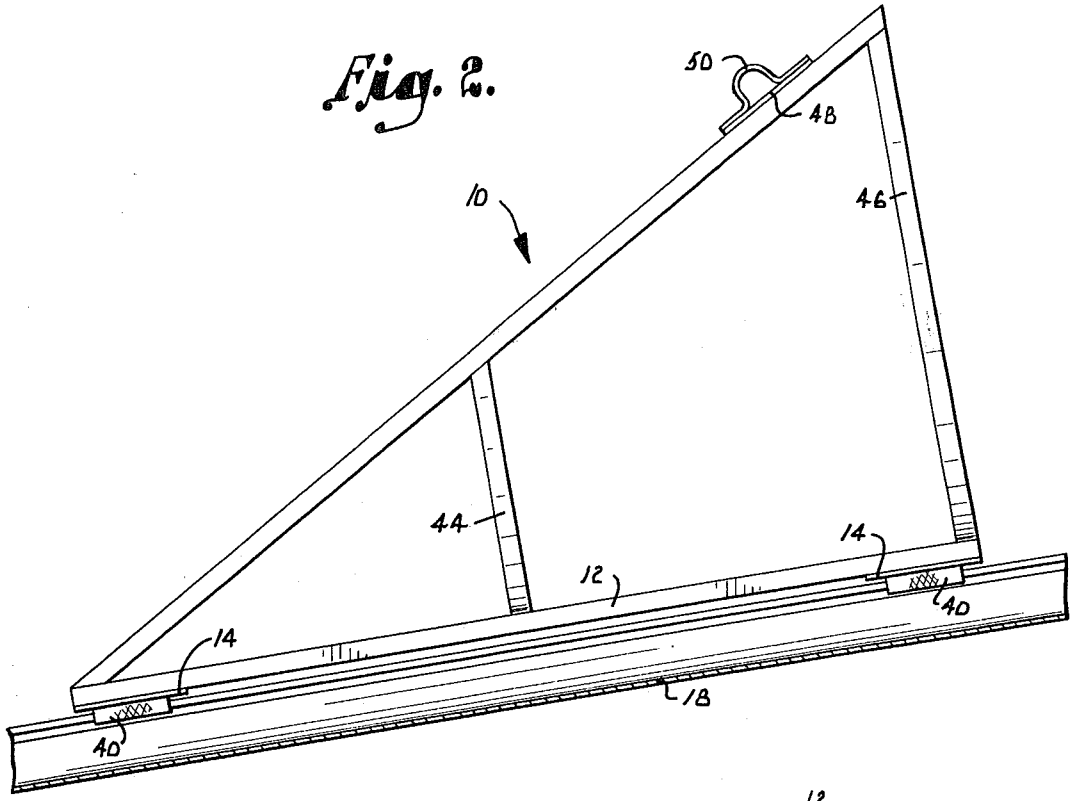
FIG. 2 is a side elevational view thereof.
Figure 3:
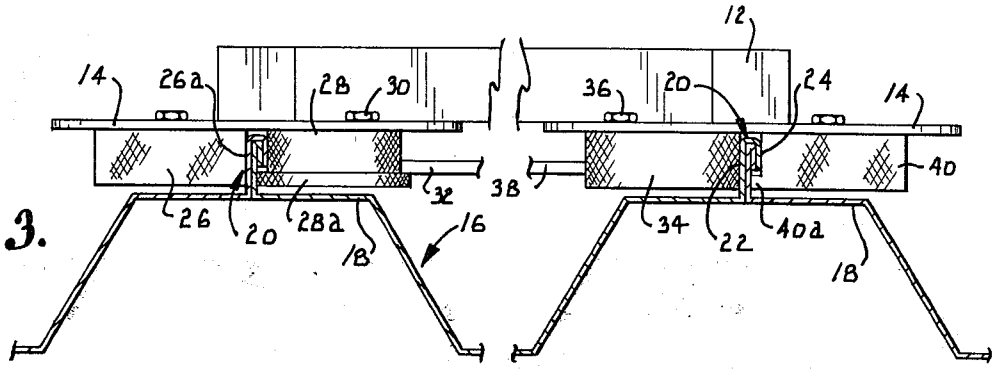
FIG. 3 is an enlarged fragmentary view looking in the direction of arrows 3—3 of FIG. 1.

At this point, reference is made to FIG. 3 and the fact that the device 10 is intended to be used with a standing seam roof designated generally by the numeral 16. Roof 16 is comprised of a number of individual panels 18 which are joined together in a standing seam 20. Each seam 20 has a flat back side 22 and a stepped or folded side 24. The step results from two panel sections being joined together and folded over by machine as the roof is constructed. It is to be understood that, while the drawing shows only a single fold of the roof panels 18, in some instances a double fold will actually be made.

Returning to the construction of device 10, the structure associated with each of mounting plates 14 on the lefthand side of the device is identical and therefore will only be explained once. Likewise, the structure associated with each of the righthand plates 14 is identical and only one will be described in detail. As shown in FIG. 3, a backup block 26 is rigid with plate 14 and has a flat surface 26*a* to abut against the flat side 22 of seam 20. Disposed on the opposite side of the seam from backup 26 is a camming roller 28 eccentrically mounted on plate 14 by a bolt 30. Camming roller 28 is provided with a lip 28*a* so that the overall configuration of the roller will conform to the configuration of stepped side 24 of seam 20. Roller 28 is free to pivot about the axis of bolt 30 and a handle 32 (FIG. 1) extends from the roller to assist in pivotal movement.

On the righthand side of platform 12, each of the mounting plates 14 is provided with a camming roller 34 eccentrically mounted to plate 14 by a bolt 36. Camming roller 34 has a relatively flat surface so as to conform to the flat side 22 of seam 20. A handle 38 (FIG. 1) projects from roller 34 to assist in movement of the roller about the axis of bolt 36. A backup block 40 is rigidly mounted to plate 14 and is provided with a lip 40*a* so as to present a configuration conforming to that of stepped side 24 of seam 20.

The surfaces of all of the camming rollers 28 and 34 as well as the surfaces of all of the backup blocks 26 are 40 are knurled or otherwise provided with a high friction, non-skid covering. It is also to be noted, from viewing the cutaway portion in the upper righthand corner of FIG. 1, that the pivotal axis for each of the camming rollers is so disposed that any movement of the device 10 from top to bottom will tend to cause the rollers to become more tightly wedged against seams 20. This provides a failsafe construction and substantially precludes slippage.

A generally triangular support frame 42 is rigidly mounted on platform 12 and reinforced by braces 44 and 46. A plate member 48 is rigid with framework 42 and mounts a bracket 50.

In use, device 10 is positioned on roof 16 so that rollers 28 and 34 and their respective backup blocks straddle standing seams 20. In this manner, the seams serve as a track over which device 10 may be moved. When the device is in the desired location for supporting a load, a downward pull on it will cause camming rollers 28 and 34 to tightly grip the standing seams. In this regard, handles 38 may be manipulated to help insure a tight grip of the camming rollers. In most applications of the device, a lanyard rope (not shown) will be threaded through bracket 50 so that the device may be used to support a workman at a remote location on the building. Bracket 50 is so positioned that the downward force on the device will be substantially parallel to platform 12. While a lanyard support is the primary purpose for which the invention has been devised, it will be appreciated that the teachings of the invention are also applicable to a device which supports any kind of load either directly on the device or at a remote location through use of a rope or cable. For example, tools or construction supplies could be placed directly on platform 12 if framework 42 and its supporting braces were removed. Also, a pair of the devices 10 could be used to support a scaffold hanging from the side of the building.

When the device 10 is to be moved to a different location, handles 38 are used to pivot rollers 28 and 34 so as to release their grip on seams 20. When this is done, the device may be moved along the seams or picked up and positioned on different seams. From the foregoing, it will be appreciated that a substantially improved support device for standing seam metal roofs is provided, meeting all of the objectives heretofor set forth.

I claim:

1. A device for supporting a load on a standing seam roof, said device comprising:

platform means for spanning the distance between two parallel roof seams;

camming means mounted on opposite sides of said platform means for engaging said parallel roof seams, each of said camming means being coupled with said platform for movement toward and away from the respective seams;

backup means mounted on opposite sides of said platform means in alignment with said camming means and disposed for positioning against said roof seams on the opposite sides from said camming means to provide backup support for said camming means when the latter engages said roof seam; and means for locking said camming means against said roof seams.

2. The invention of claim 1, wherein said means for locking said camming means comprises eccentric mounting means for said camming means whereby movement of said platform means in one direction locks said camming means.

3. The invention of claim 1, wherein said camming means comprises four camming surfaces for equal engagement with said parallel roof seams and said backup means comprises four backup surfaces corresponding to said four camming surfaces.

4. The invention of claim 3, wherein is included a support extending upwardly from said platform means.

5. The invention of claim 4, wherein said means for locking said camming means comprises eccentric mounting means for said camming means whereby movement of said platform means in one direction locks said camming means.

6. The invention of claim 1, wherein each of said standing seams presents a flat side and a folded side and wherein said camming means presents first and second cams each having a surface configured to conform to said folded side of one seam and third and fourth cams each having a flat surface to conform to said flat side of the other seam, said backup means comprising first and second flat backup surfaces corresponding to said first and second cams and third and fourth backup surfaces configured to conform to the folded side of said other seam.

7. The invention of claim 6, wherein said means for locking said camming means comprises eccentric mounting means for said camming means whereby movement of said platform means in one direction locks said camming means.

8. The invention of claim 7, wherein is included a support extending upwardly from said platform means.

* * * * *